US006106637A

United States Patent [19]

Arnaud et al.

[11] Patent Number: 6,106,637

[45] Date of Patent: Aug. 22, 2000

[54] READY-TO-USE METAL WIRE AND METHOD FOR PRODUCING SAME

[75] Inventors: Jean-Claude Arnaud, Montachany; Eric Depraetere, Thuret; Marc Francois, Metz; Raoul Serre, Ceyrat, all of France

[73] Assignee: Michelin & Cie, Cedex, France

[21] Appl. No.: 09/101,652

[22] PCT Filed: Jan. 8, 1997

[86] PCT No.: PCT/FR97/00028

§ 371 Date: May 3, 1999

§ 102(e) Date: May 3, 1999

[87] PCT Pub. No.: WO97/26379

PCT Pub. Date: Jul. 24, 1997

[30] Foreign Application Priority Data

Jan. 16, 1999 [FR] France ..... 96 00406

[51] Int. Cl.[7] ..... C21D 8/06; C22C 38/18; C22C 38/12

[52] U.S. Cl. ..... 148/320; 148/333; 148/334; 148/530; 148/532; 148/534; 148/537; 148/599; 148/598; 148/595; 428/598; 428/595; 428/606

[58] Field of Search ..... 148/530, 532, 148/537, 534, 599, 598, 595, 320, 333, 334; 428/606, 607

[56] References Cited

U.S. PATENT DOCUMENTS

| | | | |
|---|---|---|---|
| 5,167,727 | 12/1992 | Kim et al. | 148/599 |
| 5,261,974 | 11/1993 | Hyodo et al. . | |
| 5,503,688 | 4/1996 | Arnaud et al. . | |

FOREIGN PATENT DOCUMENTS

| | | |
|---|---|---|
| 0330752 | 9/1989 | European Pat. Off. . |
| 6336648 | 12/1994 | Japan . |
| 2088257 | 6/1982 | United Kingdom . |
| WO8402354 | 6/1984 | WIPO . |

*Primary Examiner*—Deborah Yee
*Attorney, Agent, or Firm*—BakerBotts L.L.P.

[57] ABSTRACT

A ready-to-use metal wire comprising microalloyed steel with a structure almost entirely made up of a cold-hammered annealed martensite is disclosed. The wire diameter is of at least 0.10 mm and at most 0.50 mm, and the ultimate tensile strength of the wire is of at least 2800 MPa. The method of producing said wire comprises deforming a wire rod, performing a hardening heat treatment on the deformed wire and heating it to an annealing temperature to cause the formation of a structure almost entirely made up of annealed martensite. The wire is then cooled and deformed. Assemblies comprising at least one such wire, and wire or assemblies used in particular for reinforcing pneumatic tires, are also disclosed.

28 Claims, No Drawings

READY-TO-USE METAL WIRE AND METHOD FOR PRODUCING SAME

This application is a 371 of PCT/FR97/00028 filed Jan. 8, 1997.

BACKGROUND OF THE INVENTION

The invention concerns ready-to-use metal wires and methods for obtaining said wires. These ready-to-use wires are utilized, for example, to reinforce plastic or rubber articles, and in particular pipes, belts, plys and pneumatic tires.

The term "ready-to-use wire" as employed in this application means, in a manner known in the field, that this wire can be used for the proposed application without subjecting it to a heat treatment that could modify its metallurgical structure, and without subjecting it to deformation of its metal substance, for example, to a drawing process that can modify its diameter.

Patent application WO-A-92/14811 describes a method for obtaining ready-to-use wire comprising a steel substrate whose structure involves more than 90% cold-hammered annealed martensite, the steel having a carbon content of not less than 0.05% and not more than 0.6%, this substrate being coated with a metal alloy other than steel, for instance a brass alloy. The method for obtaining this wire includes a hardening treatment on a cold-hammered wire, involving heating the wire above transformation point AC3 to give it a homogeneous austenitic structure and then quick-cooling it at the rate of at least 150° C./second, below the end point of the martensitic transformation. After this hardening treatment, at least two metals are deposited on the wire, and the wire is heated to stimulate by diffusion the formation of an alloy of these two metals, generally brass. The wire is then cooled and cold-hammered. The method described in this document includes the following specific advantages:

1. the use of a starting wire rod with a carbon content less than that of perlitic steel;
2. great flexibility in the choice of wire rod diameters and of the ready-to-use wire thus obtained;
3. drawing done starting with the wire rod at high speeds and with fewer breaks;
4. the diffusion treatment is done at the time the wire is annealed, which holds down production costs.

However, the method described in this document has the following drawbacks:

a) The annealing temperature necessary to achieve good diffusion of the coating does not always correspond precisely to the temperature necessary to obtain sufficient strength prior to drawing.

b) The mechanical properties obtained after annealing vary rapidly in terms of the temperature variation introduced following the inevitable dispersion of the heating systems.

c) The hardenability of the steel is insufficient; in other words, it is necessary to cool it at high speed in order to obtain a structure that is totally or almost totally martensitic. If the cooling speed is too slow, phases other than martensite can appear, such as bainite, for example. This high hardening speed is a major manufacturing constraint.

It is generally known that, in the methods for fabricating martensitic steel pieces, the addition of an alloy element such as vanadium or chromium makes it possible to improve the hardenability and strength following the precipitation of carbonitrides and/or vanadium or chromium carbides during annealing. However, the usual treatment times are several tens of minutes, even several hours, so as to permit precipitation.

SUMMARY OF THE INVENTION

It has been determined, quite unexpectedly, that the precipitation in the form of carbonitrides and/or carbides of an alloy element such as vanadium, molybdenum or chromium could take place rapidly in wires with a diameter under 3 mm, and that this precipitation during annealing made it possible to avoid the above cited drawbacks a) and b), and the presence of these alloys during hardening made it possible to avoid drawback c) cited above, by permitting gentler hardening.

Consequently, the invention covers a ready-to-use metal wire with the following characteristics:

a) It comprises a microalloyed steel with a carbon content of not less than 0.2% by weight and not more than 0.6% by weight; the steel also contains at least one alloy element chosen from the group consisting of vanadium, molybdenum and chromium, the steel containing not less than 0.08% and not more than 0.5% by weight of the alloy element or of all the alloy elements combined;

b) The steel has a structure consisting almost entirely of cold-hammered annealed martensite;

c) The wire diameter is not less than 0.10 mm and not more than 0.50 mm;

d) The wire rupture strength is not less than 2800 Mpa.

This ready-to-use wire is preferably coated with a metal alloy other than steel, deposited on a microalloy steel substrate with the abovementioned characteristics.

The method according to the invention to produce this ready-to-use wire is characterized by the following points:

a) It starts with a steel wire rod; the steel has a carbon content of not less than 0.2% by weight and not more than 0.6% by weight; the steel also contains at least one alloy element chosen from the group comprised of vanadium, molybdenum and chromium, with steel comprising not less than 0.08% and not more than 0.5% by weight of the alloy component or of all the alloy components combined;

b) The wire rod is deformed so that the diameter of the wire after such deformation is less than 3 mm;

c) The deformation is stopped, and the deformed wire undergoes a hardening heat treatment; this treatment consists in heating the wire to above the point of transformation AC3 to give it a homogeneous austenitic structure, then cooling it at least practically to the end point of martensitic transformation $M_F$, the speed of this cooling being not less than 60° C./s, in order to obtain a structure comprised almost entirely of martensite;

d) The wire is then heated to a temperature, referred to as the annealing temperature, of not less than 250° C. and not more than 700° C., in order to cause the formation for the steel of a precipitation of at least one carbonitride and/or carbide of the alloy element or of at least one alloy component, and the formation of a structure consisting almost entirely of annealed martensite;

e) The wire is then cooled to a temperature of less than 250° C.;

f) The wire is then deformed at a deformation rate $\epsilon$ of not less than 1.

Preferably, following step c) as defined above, at least two metals are deposited on the wire that are capable for forming an alloy by diffusion, with the above cited microalloy steel thus serving as a substrate and, during step d) defined above, heating to the annealing temperature also serves to cause the formation by diffusion of an alloy of these metals, for example of brass.

The invention also concerns assemblies including at least one ready-to-use wire pursuant to the invention. These assemblies are, for example, strands, wire cables, and in particular cables made of wire layers or cables consisting of wire strands.

The invention also covers articles reinforced at least in part by ready-to-use wires or by assemblies pursuant to the preceding definitions, such articles being, for example, pipes, belts, plys or pneumatic tires.

The term "structure consisting essentially of annealed martensite" means that this structure contains less than 1% of non-martensitic phase or phases, such other phase or phases being due to, unavoidable heterogenous zones in the steel.

The invention can be readily understood by means of the following exemplified embodiments.

DESCRIPTION OF PREFERRED EMBODIMENTS

I. Definitions and tests

1. Dynamometric measurements

Rupture strength measurements are made under traction in accordance with the method described in French standard AFNOR NF A 03-151 of June 1978.

2. Deformation

By definition, deformation $\epsilon$ is obtained using the formula:

$$\epsilon = \mathrm{Ln}\ (S_0/S_f)$$

wherein L is the neper logarithm, $S_0$ is the initial cross-section of the wire prior to this deformation, and $S_f$ is the cross-section of the wire after such deformation.

3. Structure of the steels

The structure of the steels is determined visually using an optical microscope with a magnification of 400. Preparation of the samples by chemical etching and examination of the structures are carried out pursuant to the following reference: *De Ferri Metallographica* Vol. II, A. Schrader, A. Rose, Edition Verlag Stahleisen GmbH, Düsseldorf.

4. Determination of point $M_F$

The martensitic transformation end point $M_F$ is determined in accordance with the following reference, *Ferrous Physical Metallurgy,* A. Kumar Sinha, Edition Butterworths 1989.

In that connection, the following ratio is used:

$$M_F = M_S - 215°\ \mathrm{C.}$$

with the ratio $$M_S = 539 - 423.C - 30.4.Mn - 17.7Ni - 12.1.Cr - 7.5Mo - 7.5.Si + 10.Co.$$

wherein C, Mn, Ni, Cr, Mo, Si and Co represent the % by weight, in other words, the weighted %, of the chemical bodies of which they are the symbols.

Vanadium may be used in this formula since it has the same effect as molybdenum, though the above cited reference does not mention vanadium.

5. Vickers Hardness

This hardness as well as the method for determining it are described in French standard AFNOR A 03-154.

6.Rate of diffusion of brass

This rate is determined by X-ray diffraction, using a cobalt anode (30 kV, 30 mA), the area of the peaks of phases $\alpha$ and $\beta$ (pure copper being determined when blended with phase $\beta$), being determined following decoiling of the two peaks.

The rate of diffusion $T_d$ is given by the following formula:

$$T_d = [\text{area of peak } \alpha]/[\text{area of peak } \alpha + \text{area of peak } \beta]$$

Peak $\alpha$ corresponds approximately to a 50° angle, and peak $\beta$ corresponds approximately to a 51° angle.

II—EXAMPLES

Four wire rods with a diameter of 5.5 mm and identified as A, B, C and D are used. The composition of the steel in these wires is given in Table 1 below.

TABLE 1

| | C | Mn | Si | V | S | P |
|---|---|---|---|---|---|---|
| Wire A, B | 0.427 | 0.619 | 0.222 | 0 | <0.003 | <0.003 |
| Wire C | 0.428 | 0.621 | 0.224 | 0.103 | <0.003 | <0.003 |
| Wire D | 0.419 | 0.611 | 0.222 | 0.156 | <0.003 | <0.033 |

The steel of these wire rods has a perlitic structure.

The other components of these wire rods have unavoidable impurities and are present in negligible amounts.

The values of $M_F$ and of AC3 for these wire rods are given in Table 2.

TABLE 2

| | $M_F$ | AC3 |
|---|---|---|
| Wire A and B | 123° C. | 769° C. |
| Wire C | 122° C. | 779° C. |
| Wire D | 125° C. | 786° C. |

The values of AC3 in °C. are given by the following Andrews formula (JISI, July 1967, pages 721–727):

$$AC3 = 910 - 203\sqrt{C} - 15.2.Ni + 44.7.Si + 104.V + 31.5.Mo - 30.Mn + 13.1.W - 20.Cu + 700.P + 400.Al + 120.As + 400.Ti$$

wherein C, Ni, Si, V, Mo, Mn, W, Cu, P, Al, As and Ti represent the % by weight of the chemical bodies of which they are the symbols.

Wires A and B are therefore identical and not microalloyed, while wires C and D are microalloyed and different from one another.

These wire rods are drawn to a diameter of 1.3 mm, so that the rate of deformation $\epsilon$ is therefore equal to 2.88.

These four wires are then subjected to a hardening treatment, as follows: heating at 1000° C., maintained for 5 seconds; quick cooling to ambient temperature (around 20° C.).

Following are the hardening cooling conditions:

Wires A, C and D: speed of 130° C./second using a blend of hydrogen and nitrogen (75% by volume of hydrogen, 25% by volume of nitrogen) as hardening gas.

Wire B: speed of 180° C./second, using pure hydrogen.

The Vickers hardness is measured on each of the wires obtained, referenced A1, B1, C1 and D1, and the letters A, B, C and D each identify the abovementioned starting wire rod.

The values obtained are indicated in Table 3.

TABLE 3

| Wire A1 | Wire B1 | Wire C1 | Wire D1 |
|---|---|---|---|
| 650 | 685 | 690 | 700 |

Wire A1 is unusable because of its too low degree of hardness, which is due to the fact that its structure does not consist only of martensite but contains both martensite and bainite.

Wires B1, C1 and D1 are comprised almost entirely of martensite, and their Vickers hardness is satisfactory.

Wires C1 and D1, of microalloyed steel, are obtained with a hardness that is readily achieved (relatively low speed with an inexpensive and non-hazardous blend of gases), whereas wire B1 is obtained through a difficult and costly method (high hardening speed using pure hydrogen), a method that makes it possible to obtain a hardness that is sufficient but nevertheless less than that of microalloyed wires C1 and D1.

It is therefore clear that vanadium makes it possible to improve the hardenability of the steel, in other words, the formation of a single martensite phase at the time of hardening.

After that, a layer of copper and then a layer of zinc are deposited by electrolysis in a known manner on the three wires B1, C1 and D1. The total quantity of the two metals so deposited is 390 mg per 100 g of each of the wires, with 64% by weight of copper and 36% by weight of zinc. Thus, the three wires B2, C2 and D2 are obtained.

Control wire B2 is then heated by Joule effect for 5 seconds each time at three annealing temperatures $T_r$ (525° C., 590° C., 670° C.), and then cooled to room temperature (about 20° C.), in order to evaluate the effect of this heat treatment on the rupture strength $R_m$ and on the rate of diffusion $T_d$ of the brass formed by the alloying of copper and zinc, for the wire thus obtained, B3, in each case.

The results are given in Table 4.

TABLE 4

| $T_r$ | $R_m$ (Mpa) | $T_d$ |
|---|---|---|
| 525° C. | 1239 | 0.82 |
| 590° C. | 1120 | 0.92 |
| 670° C. | 964 | 0.95 |

It is noted that for a temperature of 525° C., the diffusion rate $T_d$ is insufficient (less than 0.85) but that the rupture strength is greater than for the other temperatures. A very good brass diffusion is obtained with a treatment at 670° C. (diffusion greater than 0.85), but the rupture strength is considerably lower than at 525° C. and is not sufficient to permit obtaining a high rupture strength with an additional drawing. The rupture strength is somewhat greater for treatment at 590° C. than at 670° C., with a brass diffusion somewhat lower, though satis-factory, but this strength is also insufficient to guarantee a high post-drawing strength.

It is also noted that the diffusion rate increases as the rupture strength decreases, which is a drawback because, in practice, the diffusion rate must be rise in proportion to the increase in rupture strength in order to permit subsequent deformation (for example, by drawing) without breaking the wire. It is therefore clear here, contrarily, that deformability decreases as rupture strength increases, which is contrary to the desired objective.

The two wires C2 and D2, which contain vanadium, are heated to 590° C. for only 5 seconds in order to do an annealing; then they are cooled to room temperature (about 20° C.). The diffusion rate $T_d$ of the brass and the rupture strength $R_m$ of wires C3 and D3 thus obtained are then determined. The results are given in Table 5.

TABLE 5

| | $R_m$ (Mpa) | $T_d$ |
|---|---|---|
| Wire C3 | 1229 | 0.92 |
| Wire D3 | 1261 | 0.92 |

It is clear that, in both cases, the brass diffusion rate is greater than 0.9, in other words, that the diffusion is very good and that the rupture strength is also very good, very much greater than that obtained for the control wire B3 when the brass diffusion is greater than 0.9. The presence of vanadium therefore unexpectedly makes it possible to have both good brass diffusion and good rupture strength thanks to the formation of fine precipitates of carbonitride and/or carbide of vanadium, which was in solution following the hardening period, despite the very short annealing time.

It is known that vanadium is precipitated in steels for very long annealing times running from about ten minutes to several hours, but it is surprising to note such precipitation for such short times, less than a minute, less, for example, than 10 seconds.

Wires B3, C3 and D3 are then deformed by drawing to obtain a final diameter of about 0.18 mm, which corresponds to a deformation rate $\epsilon$ of 4, and ready-to-use wires B4, C4 and D4 are thus obtained, on which the rupture strength $R_m$ is determined.

The results are given in Table 6.

TABLE 6

| | $T_r$ | $R_m$ (MPa) | $T_d$ |
|---|---|---|---|
| B4 | 525° C. | 2960 | 0.82 |
| B4 | 590° C. | 2820 | 0.92 |
| B4 | 670° C. | 2530 | 0.95 |
| C4 | 590° C. | 2945 | 0.92 |
| D4 | 590° C. | 2983 | 0.92 |

The values of $T_r$ are those indicated above for the annealing; and the values of $T_d$ are those indicated above which were determined after the brass coating operation and before drawing, the values to $T_d$ remaining practically unmodified during the drawing operation.

It is noted that wires C4 and D4 pursuant to the invention, obtained therefore according to the method of the invention, are characterized both by a good rate of brass diffusion (greater than 0.9), and by excellent rupture strength (greater than 2900 Mpa). The control wires B4 have rupture strength values sub-stantially lower than those of wires C4 and D4 pursuant to the invention, except for wire B4, initially treated at an annealing temperature of 525° C., but then the rate of brass diffusion is insufficient (less than 0.85), in other words, drawing is tricky and leads to frequent breaks in the wire when it is deformed, which in turn makes it much more difficult to obtain wire than in the case of wires C4 and D4 of the invention.

The preceding examples pursuant to the invention used a vanadium steel, but the invention is applicable also to cases where at least one of the metals molybdenum or chromium is used, and to cases where at least two of the metals chosen from the group comprised of vanadium, molybdenum and chromium are used.

The wire rod that can be used for the invention is prepared in the usual way for a wire rod intended to be transformed into a ready-to-use wire for reinforcing tire treads. The method begins with a molten steel bath having the composition indicated for the wire rod pursuant to the invention. This steel is first prepared in an electric furnace or an oxygen converter, then deoxidized in the ladle by means of an oxidizing agent, such as silicon, which poses no risk of producing any aluminum oxide inclusions. Vanadium is then introduced into the ladle in the form of bulk pieces of ferrovanadium by addition to the metallic bath.

The method is similar if the alloying element has to be chromium or molybdenum.

Once ready, the steel bath is poured continuously in the form of billets or blooms. These semi-products are then rolled in a conventional manner into wire rods with a diameter of 5.5 mm, first in billets, if blooms are involved, or directly into wire rod if billets are involved.

Preferably, at least one of the following characteristics for the wire in accordance with the invention is present:

the carbon content of the steel is at least 0.3% and at most 0.5% (% by weight), this content being around 0.4%, for example;

the steel shows the following ratios: $0.3\% \leqq Mn \leqq (0.6\%$; $0.1\% \leqq Si \leqq 0.3\%$; $P \leqq 0.02\%$; $S \leqq 0.02\%$ (% by weight);

the alloying element or all the alloying elements represent at most 0.3% by weight of the steel;

the rupture strength is at least 2900 MPa;

the diameter is at least 0.15 mm and not more than 0.40 mm.

Preferably, at least one of the following characteristics for the method in accordance with the invention is present:

the carbon content of the steel of the wire rod used is not less than 0.3% and not more than 0.5% (% by weight), this content being around 0.4%, for example;

the wire rod steel shows the following ratios:

$0.3\% \leqq Mn \leqq 0.6\%$; $0.1\% \leqq Si \leqq 0.3\%$; $P \leqq 0.02\%$; $S \leqq 0.02\%$ (% by weight);

the alloying element or all the alloying elements represent at most 0.3% by weight of the steel;

the cooling speed during hardening is less than 150° C./second;

the annealing temperature is not less than 400° C. and not more than 650° C.;

the wire is cooled to room temperature after it has been raised to the annealing temperature;

the deformation rate $\epsilon$ following the annealing treatment is not less than 3.

Still more preferentially, the alloying element in the ready-to-use wire and in the method according to the invention is vanadium alone, which has the advantage of giving small precipitates, whereas chromium gives large precipitates, and molybdenum tends to cause segregation. If chromium is used alone, its content in the steel is, advantageously, not less than 0.2%.

The deformation of the wire in the preceding examples was accomplished by drawing, but other techniques are possible, rolling for example, possibly combined with drawing, for at least one of the deformation operations.

Of course, the invention is not limited to the exemplified embodiments described above, so that, for example, the coating of the ready-to-use wire according to the invention is an alloy other than brass, this alloy being obtained with two metals, or more than two metals, for example, ternary copper-zinc-nickel, copper-zinc-cobalt, copper-zinc-tin alloys, the essential aspect being that the metals used must be capable of forming an alloy by diffusion at a temperature not higher than the annealing temperature.

We claim:

1. A ready-to-use microalloyed steel wire, the steel comprising:

a) from 0.2% by weight to 0.6% by weight of carbon; and b) from 0.08% to 0.5% by weight of an alloying element selected from the group consisting of vanadium, molybdenum, chromium, and mixtures thereof;

wherein the microalloyed steel consists essentially of cold-hammered annealed martensite; the diameter of the steel wire is from 0.10 mm to 0.50 mm; and the tensile strength of the steel wire is greater than or equal to 2800 MPa.

2. The wire according to claim 1, further comprising a metallic alloy coating other than steel that is deposited onto the microalloyed steel.

3. The wire according to claim 2, wherein the metallic alloy coating is brass.

4. The metal wire according to claim 1, wherein the microalloyed steel comprises from 0.3% to 0.5% by weight of carbon.

5. The wire according to claim 1, wherein the microalloyed steel comprises approximately 0.4% by weight of carbon.

6. The wire according to claim 1, wherein the microalloyed steel comprises: $0.3\% \leqq Mn \leqq 0.6\%$ by weight; $0.1\% \leqq Si \leqq 0.3\%$ by weight; $P \leqq 0.02\%$ by weight; and $S \leqq 0.02\%$ by weight.

7. The wire according to claim 1, wherein the microalloyed steel comprises less than or equal to 0.3% by weight of the alloying element.

8. The wire according to claim 1, wherein the alloying element is vanadium.

9. The wire according to claim 1, wherein the microalloyed steel comprises greater than or equal to 0.2% by weight of a chromium alloying element.

10. The wire according to claim 1, wherein the tensile strength of the wire is greater than or equal to 2900 MPa.

11. The wire according to claim 1, wherein the diameter of the wire is from 0.15 mm to 0.40 mm.

12. A process for producing a ready-to-use microalloyed steel wire, the process comprising the steps of:

a) deforming a microalloyed steel wire rod to a diameter of less than 3 mm, wherein the steel comprises from 0.2% by weight to 0.6% by weight of carbon, and from 0.08% by weight to 0.5% by weight of an alloying element selected from the group consisting of vanadium, molybdenum, chromium, and mixtures thereof;

b) heating the deformed wire above the point of transformation AC3 to give it a homogeneous austenitic structure;

c) cooling the wire at least almost to the end point of martensitic transformation $M_F$ at a cooling rate of greater than or equal to 60° C./s in order to obtain a structure consisting essentially of martensite;

d) heating the wire to an annealing temperature in the range of 250° C. and 700° C. in order to cause the formation for the steel of a precipitation of at least one carbonitride and/or carbide of the alloying element and the formation of a structure consisting essentially of annealed martensite;

e) cooling the wire to a temperature under 250° C.; and f) deforming the wire at a deformation rate $\epsilon$ of not less than 1.

13. The process according to claim 12, further comprising, after step c), the step of depositing at least two metals onto the microalloyed steel wire, said metals being capable of forming by diffusion an alloy other than steel onto the wire.

14. The process according to claim 13, wherein the deposited metals are copper and zinc, which provide a brass alloy in step d).

15. The process according to claim 12, wherein the microalloyed steel comprises from 0.3% to 0.5% by weight of carbon.

16. The process according to claim 12, wherein the microalloyed steel comprises about 0.4% by weight of carbon.

17. The process according to claim 12, wherein the microalloyed steel comprises $0.3\% \leqq Mn \leqq 0.6\%$ by weight; $0.1\% \leqq Si \leqq 0.3\%$ by weight; $P \leqq 0.02\%$ by weight; and $S \leqq 0.02\%$ by weight.

18. The process according to claim 12, wherein the microalloyed steel comprises less than or equal to 0.3% by weight of the alloying element.

19. The process according to claim 12, wherein the alloying element is vanadium.

20. The process according to claim 12, wherein the microalloyed steel comprises 0.2% by weight of a chromium alloying element.

21. The process according to claim 12, wherein the cooling rate in step c) is less than 150° C./second.

22. The process according to claim 12, wherein the annealing temperature is from 400° C. to 650° C.

23. The process according to claim 12, wherein the wire is cooled to room temperature in step e).

24. The process according to claim 12, wherein the deformation rate $\epsilon$ greater than or equal to 3.

25. A reinforcing assembly comprising at least one wire according to claim 1.

26. An article of manufacture that is reinforced in part by wires according to claim 1.

27. A pneumatic tire that is reinforced in part by wires according to claim 1.

28. A pneumatic tire comprising a reinforcing assembly according to claim 25.

* * * * *

UNITED STATES PATENT AND TRADEMARK OFFICE

CERTIFICATE OF CORRECTION

PATENT NO. : 6,106,637

DATED : August 22, 2000

INVENTOR(S) : Arnaud, et al.

It is certified that error appears in the above-identified patent and that said Letters Patent is hereby corrected as shown below:

Column 10, line 13, "$\epsilon$ greater" should read --$\epsilon$ is greater--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*